US005717978A

United States Patent [19]

Mestha

[11] Patent Number: 5,717,978

[45] Date of Patent: Feb. 10, 1998

[54] METHOD TO MODEL A XEROGRAPHIC SYSTEM

[75] Inventor: Lingappa K. Mestha, Fairport, N.Y.

[73] Assignee: Xerox Corporation, Stamford, Conn.

[21] Appl. No.: 645,300

[22] Filed: May 13, 1996

[51] Int. Cl.[6] ..... G03G 15/00; G03G 15/02; G03G 15/08

[52] U.S. Cl. ..... 399/46; 399/48; 399/50; 399/53

[58] Field of Search ..... 399/50, 168, 170–176, 399/53, 27, 46, 48

[56] References Cited

U.S. PATENT DOCUMENTS

| | | | |
|---|---|---|---|
| 5,243,383 | 9/1993 | Parisi | 355/208 |
| 5,481,337 | 1/1996 | Tsuchiya et al. | 399/46 |
| 5,523,831 | 6/1996 | Rushing | 355/208 |
| 5,606,395 | 2/1997 | Yang et al. | 399/81 |

*Primary Examiner*—R. L. Moses
*Attorney, Agent, or Firm*—Ronald F. Chapuran

[57] ABSTRACT

An electrostatographic printing machine having an imaging member with a surface voltage potential and a control system having changeable set point parameters to provide a dual level of control of the voltage potential. A compensator responsive to a reference signal and the surface voltage potential provides one input signal and one level of control to a summing nod and a look up table responsive to the changing of the set point pa provides a second input signal and a second level of control to the summing node to adjust the surface voltage potential. Two levels of table look up feed forward adjustment are also provided for developer control. Within one use of some form of look up tables to move one operating point by varying nominal values a state space control model of one electrostatic printing machine is developed. Control model is used to design good process loop compensators.

24 Claims, 11 Drawing Sheets

Implementation of Look Up Table for Level 1 Control

Electrostastic Control for Small Signal

Implementation of Look Up Table for Level 2 Control

METHOD TO MODEL A XEROGRAPHIC SYSTEM

This invention relates generally to an electrostatographic printing machine and, more particularly, concerns a process to adapt a xerographic control, in particular, to fine adjust the control for changing set points.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which subsequently transferred to a copy sheet. The copy sheet having the toner image thereon is then advanced to a fusing station for permanently affixing the toner image to the copy sheet in image configuration.

In electrostatographic machines using a drum-type or an endless belt-type photoconductive member, the photosensitive surface thereof can contain more than one image at one time as it moves through various processing stations. The portions of the photosensitive surface containing the projected images, so-called "image areas", are usually separated by a segment of the photosensitive surface called the inter-document space. After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface, and a fully discharged portion of the photosensitive surface between the image areas.

The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished color copy.

As described, the surface of the photoconductive member must be charged by a suitable device prior to exposing the photoconductive member to a light image. This operation is typically performed by a corona charging device. One type of corona charging device comprises a current carrying electrode enclosed by a shield on three sides and a wire grid or control screen positioned thereover, and spaced apart from the open side of the shield. Biasing potentials are applied to both the electrode and the wire grid to create electrostatic fields between the charged electrode and the shield, between the charged electrode and the wire grid, and between the charged electrode and the (grounded) photoconductive member. These fields repel electrons from the electrode and the shield resulting in an electrical charge at the surface of the photoconductive member roughly equivalent to the grid voltage. The wire grid is located between the electrode and the photoconductive member for controlling the charge strength and charge uniformity on the photoconductive member as caused by the aforementioned fields.

Control of the field strength and the uniformity of the charge on the photoconductive member is very important because consistently high quality reproductions are best produced when a uniform charge having a predetermined magnitude is obtained on the photoconductive member. If the photoconductive member is not charged to a sufficient level, the electrostatic latent image obtained upon exposure will be relatively weak and the resulting deposition of development material will be correspondingly decreased. As a result, the copy produced by an undercharged photoconductor will be faded. If, however, the photoconductive member is overcharged, too much developer material will be deposited on the photoconductive member. The copy produced by an overcharged photoconductor will have a gray or dark background instead of the white background of the copy paper. In addition, areas intended to be gray will be black and tone reproduction will be poor. Moreover, if the photoconductive member is excessively overcharged, the photoconductive member can become permanently damaged.

A useful tool for measuring voltage levels on the photosensitive surface is an electrostatic voltmeter (ESV) or electrometer. The electrometer is generally rigidly secured to the reproduction machine adjacent the moving photosensitive surface and measures the voltage level of the photosensitive surface as it traverses an ESV probe. The surface voltage is a measure of the density of the charge on the photoreceptor, which is related to the quality of the print output. In order to achieve high quality printing, the surface potential on the photoreceptor at the developing zone should be within a precise range.

In a typical xerographic charging system, the amount of voltage obtained at the point of electrostatic voltage measurement of the photoconductive member, namely at the ESV, is less than the amount of voltage applied at the wire grid of the point of charge application. In addition, the amount of voltage applied to the wire grid of the corona generator required to obtain a desired constant voltage on the photoconductive member must be increased or decreased according to various factors which affect the photoconductive member. Such factors include the rest time of the photoconductive member between printing, the voltage applied to the corona generator for the previous printing job, the copy length of the previous printing job, machine to machine variance, the age of the photoconductive member and changes in the environment.

One way of monitoring and controlling the surface potential in the development zone is to locate a voltmeter directly in the developing zone and then to alter the charging conditions until the desired surface potential is achieved in the development zone. However, the accuracy of voltmeter measurements can be affected by the developing materials (such as toner particles) such that the accuracy of the measurement of the surface potential is decreased. In addition, in color printing there can be a plurality of developing areas within the developing zone corresponding to each color to be applied to a corresponding latent image. Because it is desirable to know the surface potential on the photoreceptor at each of the color developing areas in the developing zone, it would be necessary to locate a voltmeter at each color area within the developing zone. Cost and space limitations make such an arrangement undesirable.

In a typical charge control system, the point of charge application and the point of charge measurement is different. The zone between these two devices loses the immediate benefit of charge control decisions based on measured voltage error since this zone is downstream from the charging device. This zone may be as great as a belt revolution or more due to charge averaging schemes. This problem is especially evident in aged photoreceptors because their cycle-to-cycle charging characteristics are more difficult to predict. Charge control delays can result in improper charging, poor copy quality and often leads to early photoreceptor replacement. Thus, there is a need to anticipate the behavior of a subsequent copy cycle and to compensate for predicted behavior beforehand.

Various systems have been designed and implemented for controlling charging processes within a printing machine. For example, U.S. Pat. No. 5,243,383 discloses a charge control system that measures first and second surface voltage potentials to determine a dark decay rate model representative of voltage decay with respect to time. The dark decay rate model is used to determine the voltage at any point on the imaging surface corresponding to a given charge voltage. This information provides a predictive model to determine the charge voltage required to produce a target surface voltage potential at a selected point on the imaging surface.

U.S. Pat. No. 5,243,383 discloses a charge control system that uses three parameters to determine a substrate charging voltage, a development station bias voltage, and a laser power for discharging the substrate. The parameters are various difference and ratio voltages.

A difficulty with the prior art is the relative inability to automatically adjust and fine tune the xerographic system in response to significant changes in parameters or set points due to system drift or operator selected quality levels. It would be desirable, therefore, to provide a system to be able to more precisely adjust a xerographic system requiring multiple changes in various system integrators and compensators.

It is an object of the present invention, therefore, to provide a xerographic control system for automatically responding to both major and minor changes in various system parameters to maintain a high quality output level. It is another object of the present invention to provide a set of feed forward look up tables integrated with a xerographic control system to automatically respond to significant set point changes in the xerographic system to maintain uniform, high quality performance.

SUMMARY OF THE INVENTION

The present invention relates to an electrostatographic printing machine having an imaging member with a surface voltage potential and a control system having changeable set point parameters to provide a dual level of control of the voltage potential. A compensator responsive to a reference signal and the surface voltage potential provides one input signal and one level of control to a summing node and a look up table responsive to the changing of the set point parameters provides a second input signal and a second level of control to the summing node to adjust the surface voltage potential. Two levels of table look up feed forward adjustment are also provided for developer control.

Other features of the present invention will become apparent as the following description proceeds and upon reference to the drawings, in which.

Figure 1:
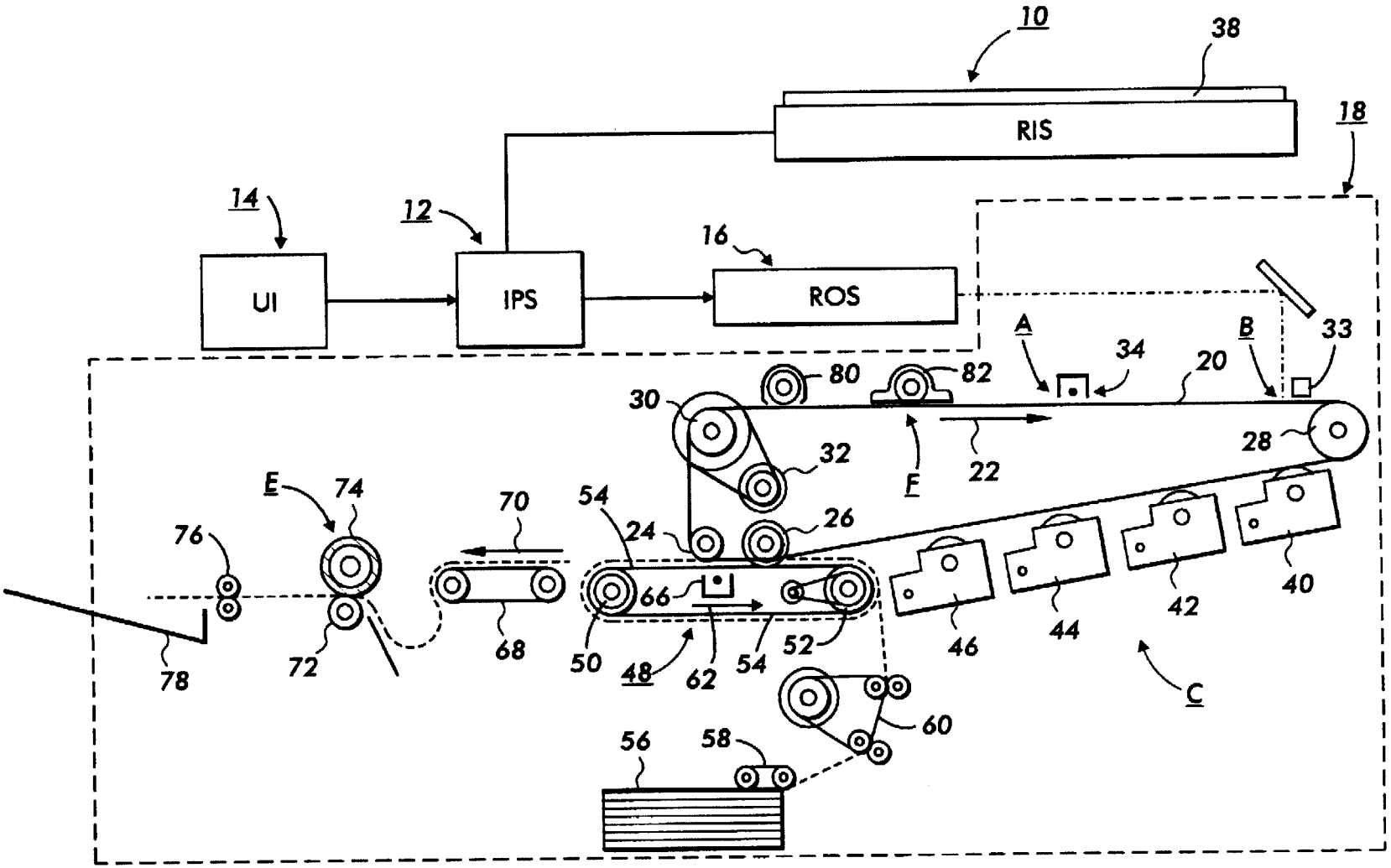
FIG. 1 is a schematic elevational view of an exemplary multi-color electrophotographic printing machine which can be utilized in the practice of the present invention.

A schematic elevational view showing an exemplary electrophotographic printing machine incorporating the features of the present invention therein is shown in FIG. 1. It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

To initiate the copying process, a multicolor original document 38 is positioned on a raster input scanner (RIS), indicated generally by the reference numeral 10. The RIS 10 contains document illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of colorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16.

ROS 16 includes a laser with rotating polygon mirror blocks. The ROS 16 illuminates, via mirror 37, a charged portion of a photoconductive belt 20 of a printer or marking engine, indicated generally by the reference numeral 18. Preferably, a multi-facet polygon mirror is used to illuminate the photoreceptor belt 20 at a rate of about 400 pixels per inch. The ROS 16 exposes the photoconductive belt 20 to record a set of three subtractive primary latent images thereon corresponding to the signals transmitted from IPS 12. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

With continued reference to FIG. 1, marking engine 18 is an electrophotographic printing machine comprising photoconductive belt 20 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the path of movement thereof.

Photoconductive belt 20 is preferably made from a polychromatic photoconductive material comprising an anti-curl layer, a supporting substrate layer and an electrophotographic imaging single layer or multi-layers. The imaging layer may contain homogeneous, heterogeneous, inorganic or organic compositions. Preferably, finely divided particles of a photoconductive inorganic compound are dispersed in an electrically insulating organic resin binder. Typical photoconductive particles include metal free phthalocyanine, such as copper phthalocyanine, quinacridones, 2,4-diaminotriazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the wire grid.

Next, the charged photoconductive surface is rotated to an exposure station, indicated generally by the reference letter B. Exposure station B receives a modulated light beam corresponding to information derived by RIS 10 having a multicolored original document 38 positioned thereat. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes subjacent to a voltage monitor, preferably an electrostatic voltmeter 33, for measurement of the voltage potential at the surface of the photoconductive belt 20. The electrostatic voltmeter 33 can be any suitable type known in the art wherein the charge on the photoconductive surface of the belt 20 is sensed, such as disclosed in U.S. Pat. Nos. 3,870,968; 4,205,257; or 4,853,639, the contents of which are incorporated by reference herein.

A typical electrostatic voltmeter is controlled by a switching arrangement which provides the measuring condition in which charge is induced on a probe electrode corresponding to the sensed voltage level of the belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit, as for example, the control circuit of the present invention. The voltage potential measurement of the photoconductive belt 20 is utilized to determine specific parameters for maintaining a predetermined potential on the photoreceptor surface, as will be understood with reference to the specific subject matter of the present invention, explained in detail hereinbelow.

The development station C includes four individual developer units indicated by reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42, and 44, respectively, apply toner particles of a specific color corresponding to the compliment of the specific color separated electrostatic latent image recorded on the photoconductive surface. Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

In FIG. 1, developer unit 40 is shown in the operative position with developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoconductive belt, while in the non-operative position, the magnetic brush is spaced therefrom. Thus, each electrostatic latent image or panel is developed with toner particles of the appropriate color without commingling.

After development, the toner image is moved to a transfer station, indicated generally by the reference letter D. Transfer station D includes a transfer zone, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another, to the sheet for forming the multi-color copy of the colored original document. One skilled in the art will appreciate that the sheet may move in a recirculating path for four cycles when undercolor black removal is used.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

Figure 2:
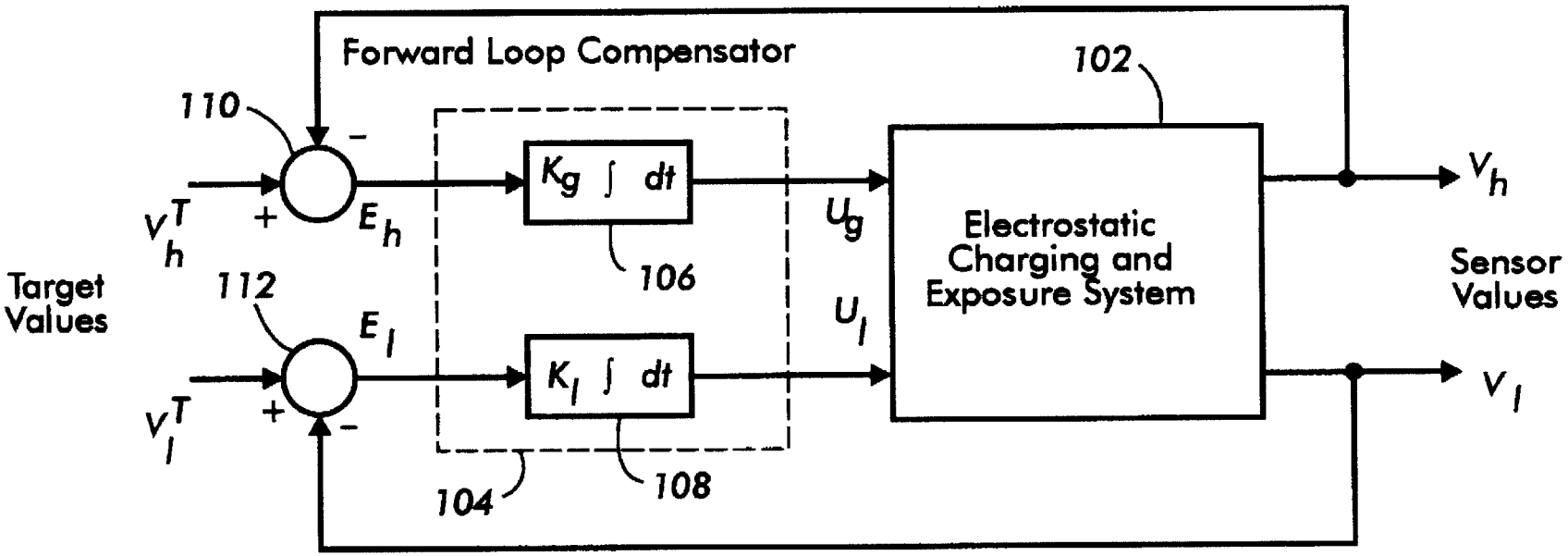
FIG. 2 is a diagram of a typical prior art electrostatic feedback control system.

A diagrammatic representation of the system currently under practice for most xerographic print engines is shown in FIG. 2. Block 102 represents the charging and exposure systems. The block 104 representing compensators usually contains suitable integrators such as 106, 108 with some weighting. Here $V_h$ represents the voltage on the unexposed photoreceptor and $V_l$ represents the voltage after the exposure. $V^T_h$ and $V^T_l$ are the desired states for the voltages $V_h$ and $V_l$. and $E_h$ is the error generated by subtracting the $V^T_h$ values with those measured by the ESV. Similarly, $E_l$ is the error generated by subtracting the $V^T_l$ values with those measured by the ESV. $U_g$ and $U_l$ are the control signals to vary the grid voltage and laser power respectively.

When the setpoint changes, there is a large error created by the system. Within a few prints $V_h$ and $V_l$ settle to new target values depending on the integrator weights. The difficult problem is in tuning the controller weights to trace the $V_h$ and $V_l$ target values so that the best print quality is preserved even if the electrostatic system drifts with time. The problem becomes even more difficult when there are many gains involved in the controller. In accordance with the present invention, special feedforward lookup tables are incorporated. The data in the tables is obtained by monitoring the elestrostatic system once during setup. After that the entire control system is represented in state-space form to fine tune the gains.

Figure 3:
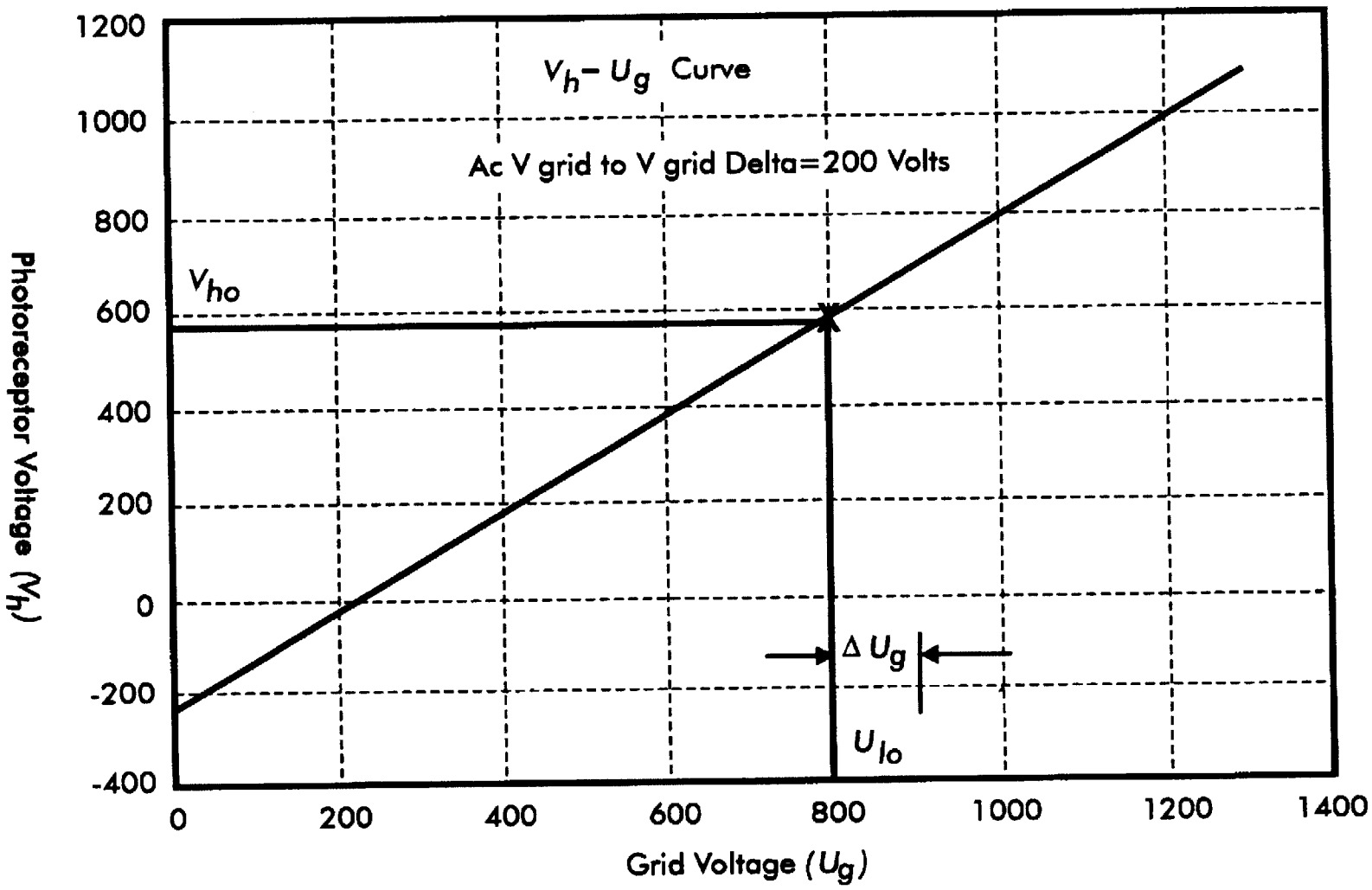
FIG. 3 is a model curve of photoreceptor voltage as a function of grid voltage.
Figure 4:
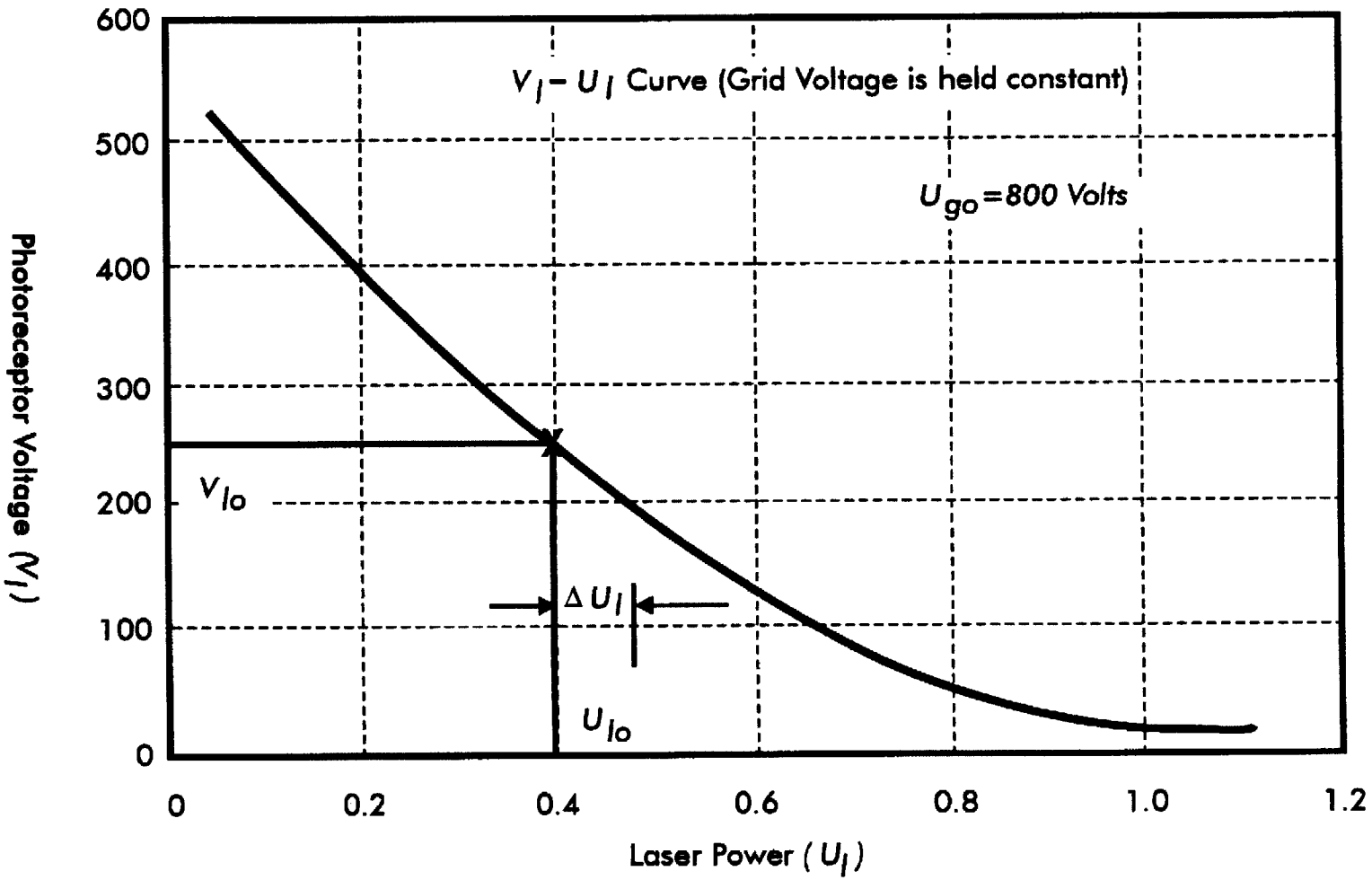
FIG. 4 is a model curve of photoreceptor voltage as a function of laser power (grid voltage constant)
Figure 5:
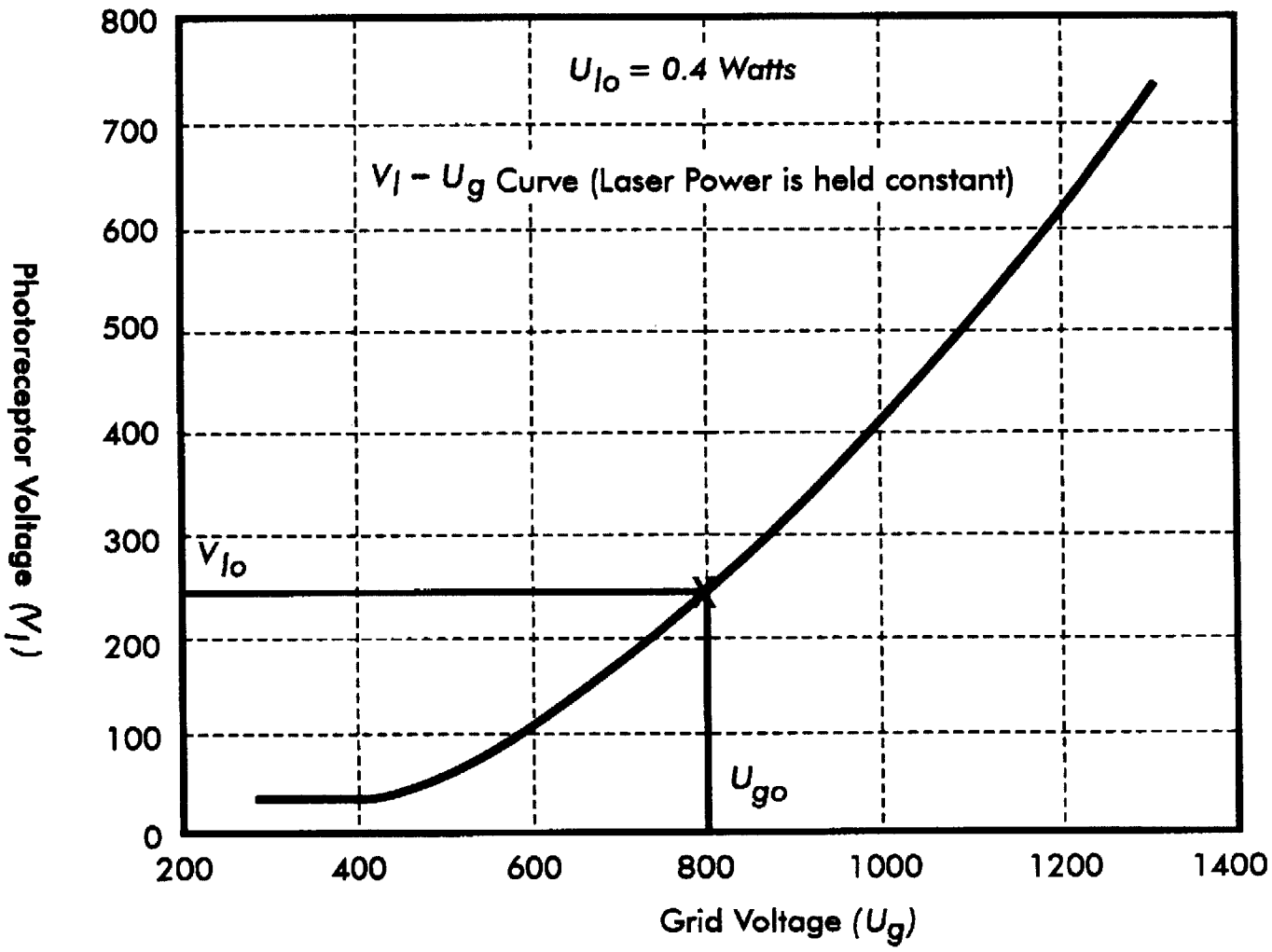
FIG. 5 is a model curve of photoreceptor voltage as a function of grid voltage (laser power constant)

The model curves for a typical electrostatic system are shown in FIGS. 3, 4 and 5. FIGS. 3 and 5 are basically photoreceptor to grid voltage curves and FIG. 4 is basically a laser power curve, a photo induced discharge curve (PIDC). Points on these marked by 'x' indicate a nominal operating point (chosen at random to illustrate the point). When the setpoints change i.e., when $V_{ho}$ and $V_{lo}$ vary, operating point 'x' changes. When there is not feedback, $V_{ho}$ is the desired voltage on the unexposed photoreceptor, then the grid voltage is set to a voltage $U_{go}$. With the grid voltage remaining at $U_{go}$, if the laser power is set equal to $U_{lo}$, then the photoreceptor will be exposed to $V_{lo}$ volts (shown in FIG. 4).

Let $B_{11}$ be the slope of the line intercepting the point marked 'x' in FIG. 3 at $U_{go}$. Let $\Delta U_g$ be the deviation around $U_{go}$. This deviation would be generated by the controller when the charging control loop is closed. Similarly, let $B_{21}$ be the slope of the line at point 'x' in FIG. 4 respectively. Also, if $\Delta U_l$ is the deviation around $U_{lo}$, then, expressions for the deviation in photoreceptor voltages. $\Delta V_{ho}$ and $\Delta V_{lo}$, are given by the following small signal model. Note that we ignored all the second and higher order terms in the small signal model, so that the system equations become linear.

$$\Delta V_h = B_{11}\Delta U_g$$

$$\Delta V_1 = B_{21}\Delta U_g = B_{22}\Delta U_l$$

Figure 6:
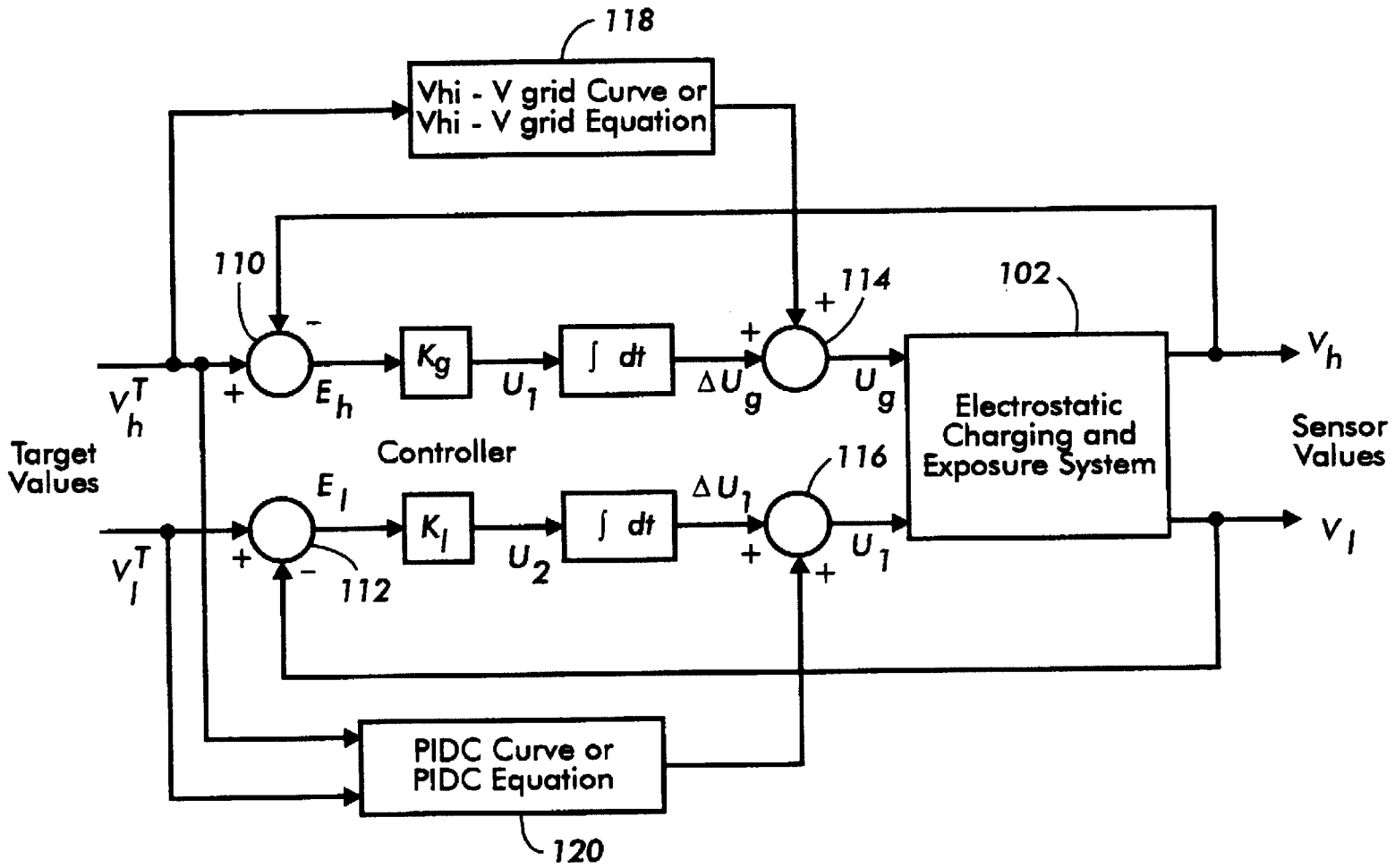
FIG. 6 is a block diagram of a Level 1 Look Up Table control in accordance with the present invention.

If we make $\Delta V_l$ and $\Delta V_h$ zero, then the control system is forced to follow the setpoints. The feedback system of FIG. 2 can be modified slightly to incorporate this notion. The block diagram of the new system is shown in FIG. 6. In this type of information, it is clear that the feedback system is working around the operating point to correct for any small changes that take place in the output. There are two feed forward look up tables 118, 120 used in this approach. The charging and PIDC curves (Curves shown in FIG. 3, 4, and 5 form the look up tables.) For a given target value, two actuator values are selected from the table of numbers. Thus, when the target values change, the corresponding value from the lookup table will provide $U_{go}$ and $U_{lo}$ to actuate the electrostatic system. Under this architecture, when the feedback loop is closed through the controller, small deviations in the actuator values, $\Delta U_g$ and $\Delta U_l$ shown in FIG. 6) correct for the voltage error. This method enables fast rise time for the output. In other words it has the scope to give dead beat control. In a dead beat control system, the output is brought exactly to any desired target value within one or two prints. The dead beat control is the most desired situation for a good printing system since with changes in target values in the middle of a job schedule, there would be no loss of any print quality.

Present day printers do not have this ability. Hence during each job run, developed mass per unit area (DMA) targets for development control are not scheduled to vary widely. For instance, for a dead beat control when different papers are used, the control performance that can be reached for an optimal overshoot in the next immediate print becomes remarkably good.

Figure 7:
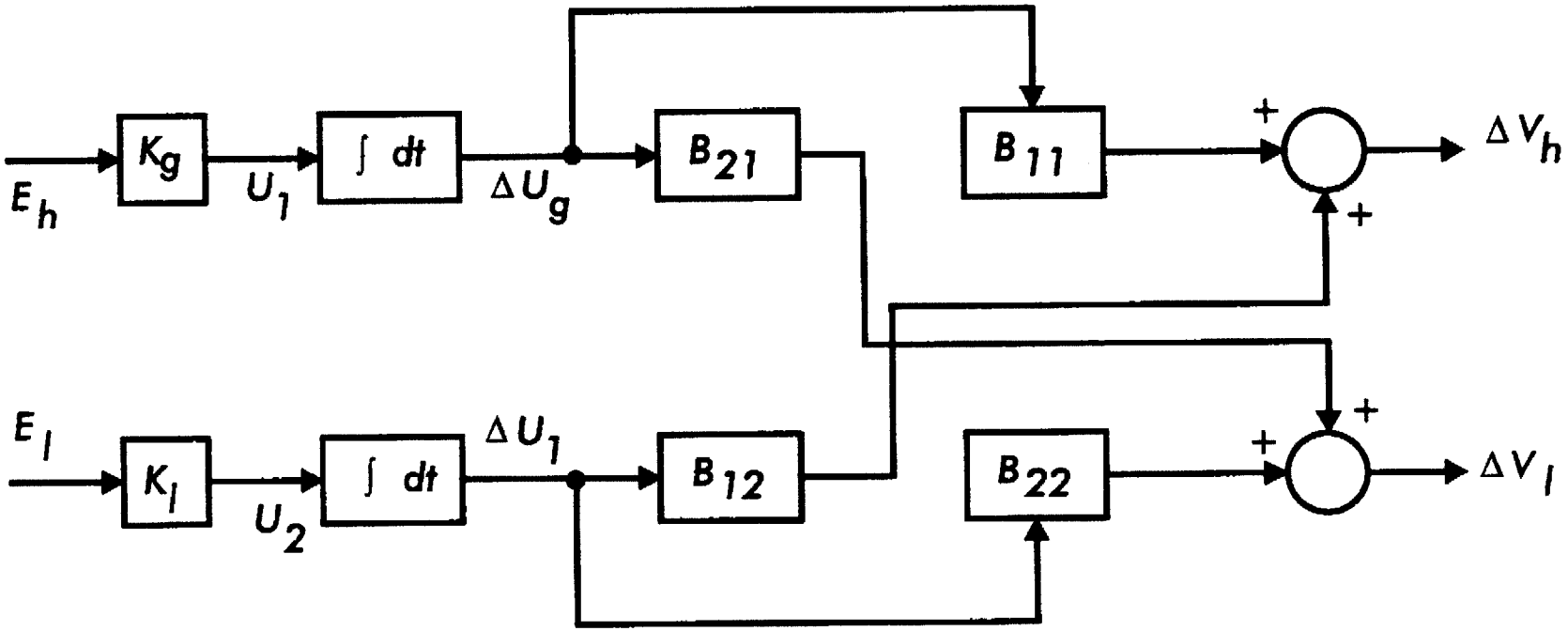
FIG. 7 is an equivalent representation of the diagram of FIG. 2.

FIG. 7 shows a control system for small signal system for a simple controller of the type shown in FIG. 2. Once the feedforward loops are implemented, the control system can be modeled in a state-space form. The following equation describes the system for the purpose of designing controllers.

With simple algebra the input output relation can be written as:

$$\begin{bmatrix} X_1(k+1) \\ X_2(k+1) \end{bmatrix} = \begin{bmatrix} 1 & 0 \\ 0 & 1 \end{bmatrix} \begin{bmatrix} X_1(k) \\ X_2(k) \end{bmatrix} + \begin{bmatrix} B_{11} & 0 \\ B_{21} & B_{22} \end{bmatrix} \begin{bmatrix} U_1(k) \\ U_2(k) \end{bmatrix}$$

$$\underline{X}(k+1) = \underline{AX}(k) + \underline{BU}(k)$$

Figure 8:
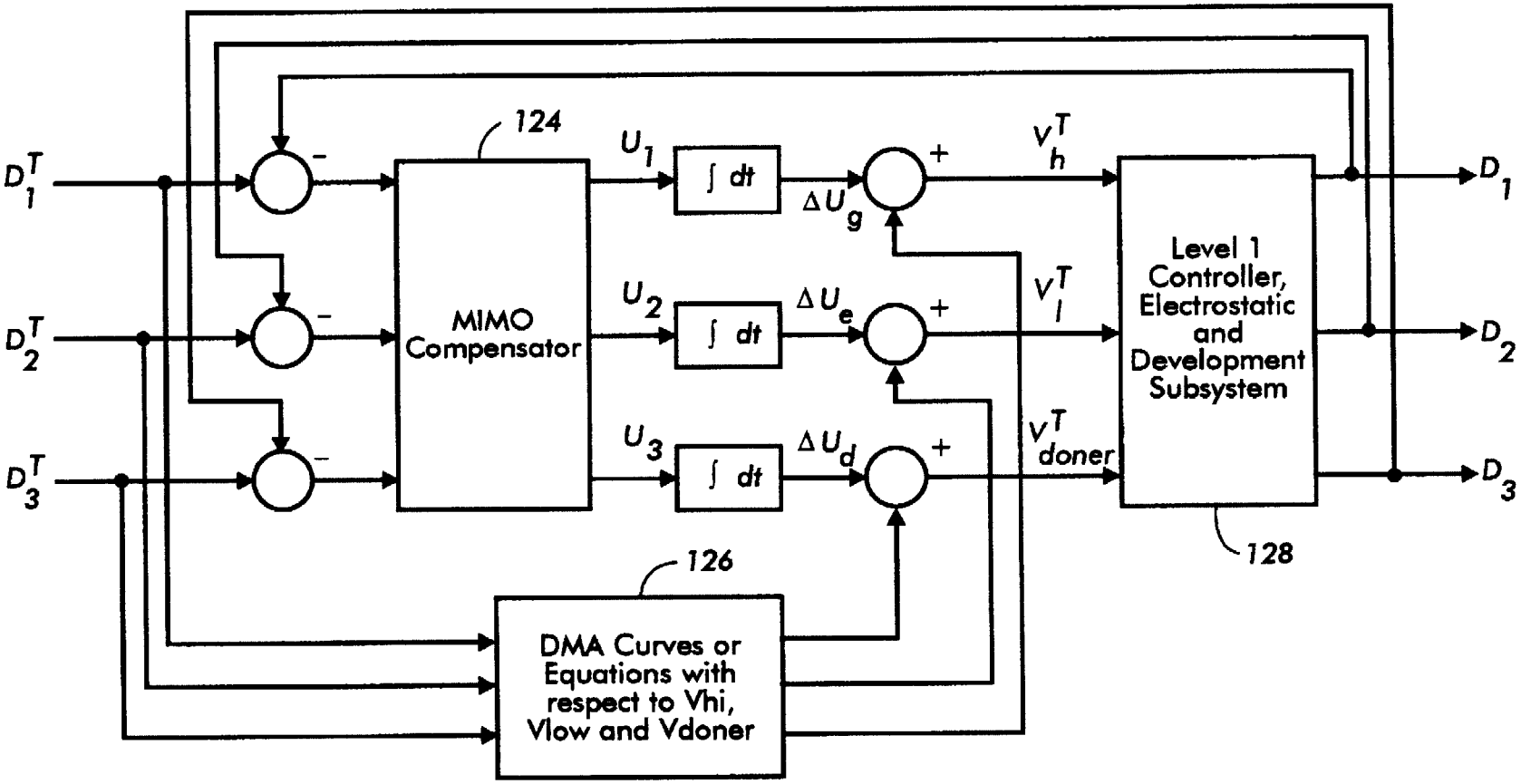
FIG. 8 is a block diagram of a Level 2 Look Up Table control in accordance with the present invention.

The design problem is to determine the gains and the architecture of the compensator to achieve optimal performance. To achieve dead beat control for the DMA, feedforward look up tables for Level 1 loops FIG. 6 alone may not be sufficient. The choice of such table approach is extended to Level 2 control as shown control in FIG. 8. Indeed, FIG. 8 is nothing but a replica of Level 1, but with a three dimensional table, instead of one and two dimensional tables. The target values to the control system are $D^T_1$, $D^T_2$, $D^T_3$ or equivalent DMA coverages. The actuator values become the donor voltage of the developer subsystem plus the target values of Level 1 control. The 'system' in this block diagram represents the complete Level 1 control of FIG. 6 from target end to the measurement end. Small signals $\Delta V_h$, $\Delta V_l$, and $\Delta V_d$ shown in FIG. 8 are added to the nominal actuator values. These are derived from the multi-input and multi-output compensator, 124. ETAC or OCD sensors measure the toner mass and $D_1$, $D_2$, and $D_3$ represents those different DMA measurements. Three DMA measurements at three different points on the toner reproduction curves keep the Level 2 multi-input multi-output control system in 3 inputs and 3 outputs form.

Figure 9:
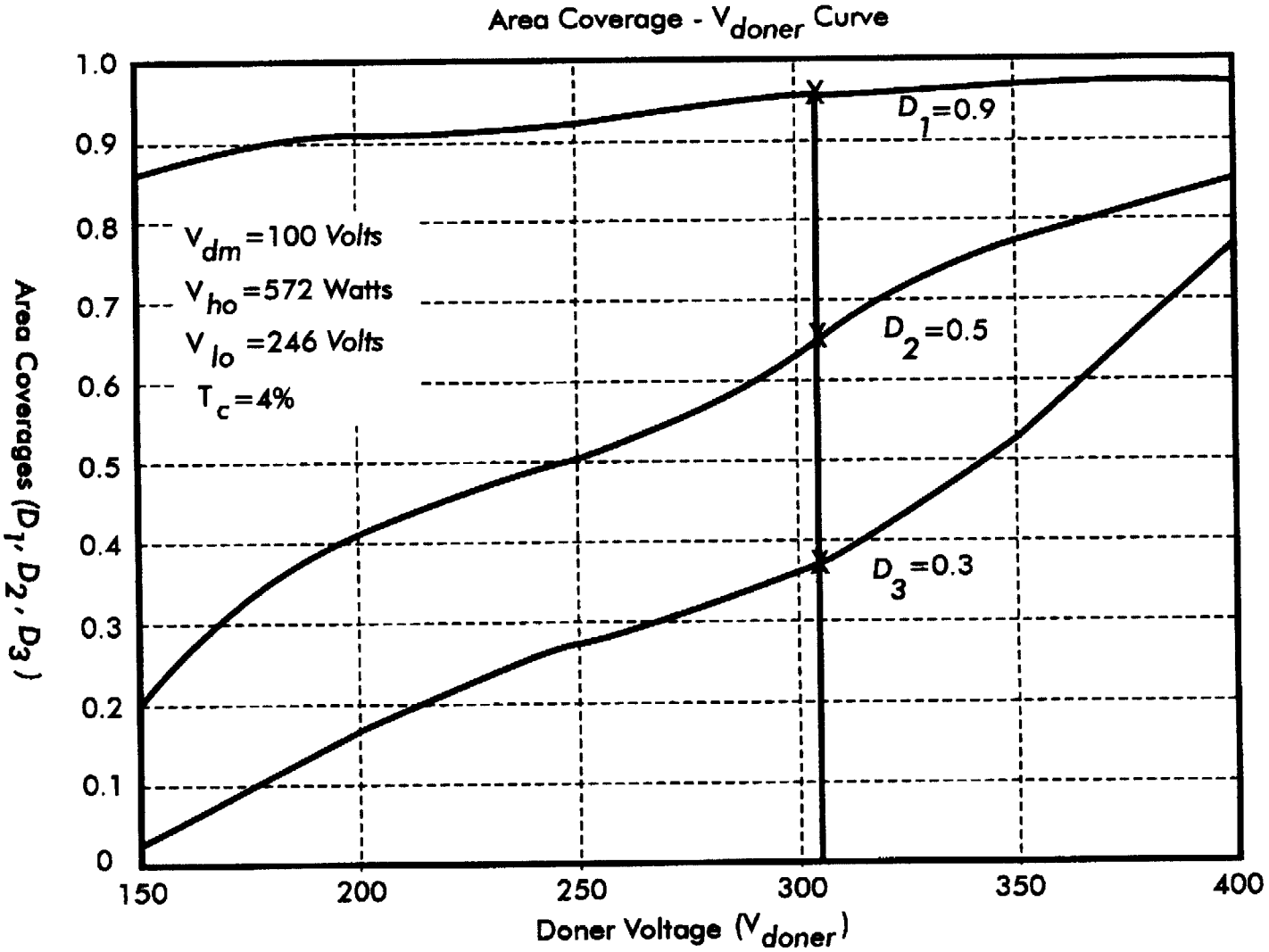
FIGS. 9, 10, and 11 are curves representing a static printer model for the system of FIG. 8.
Figure 10:
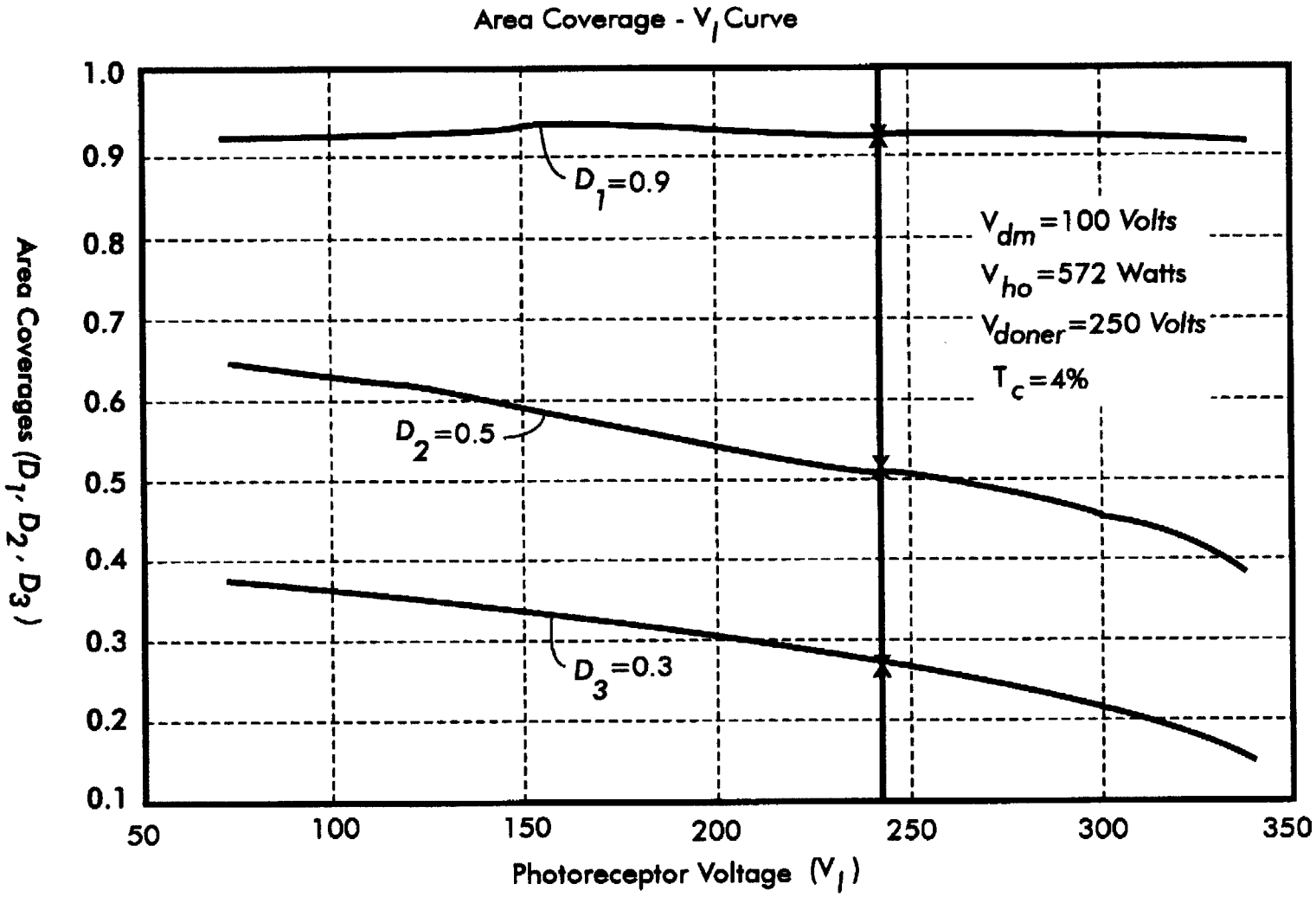
Figure 11:
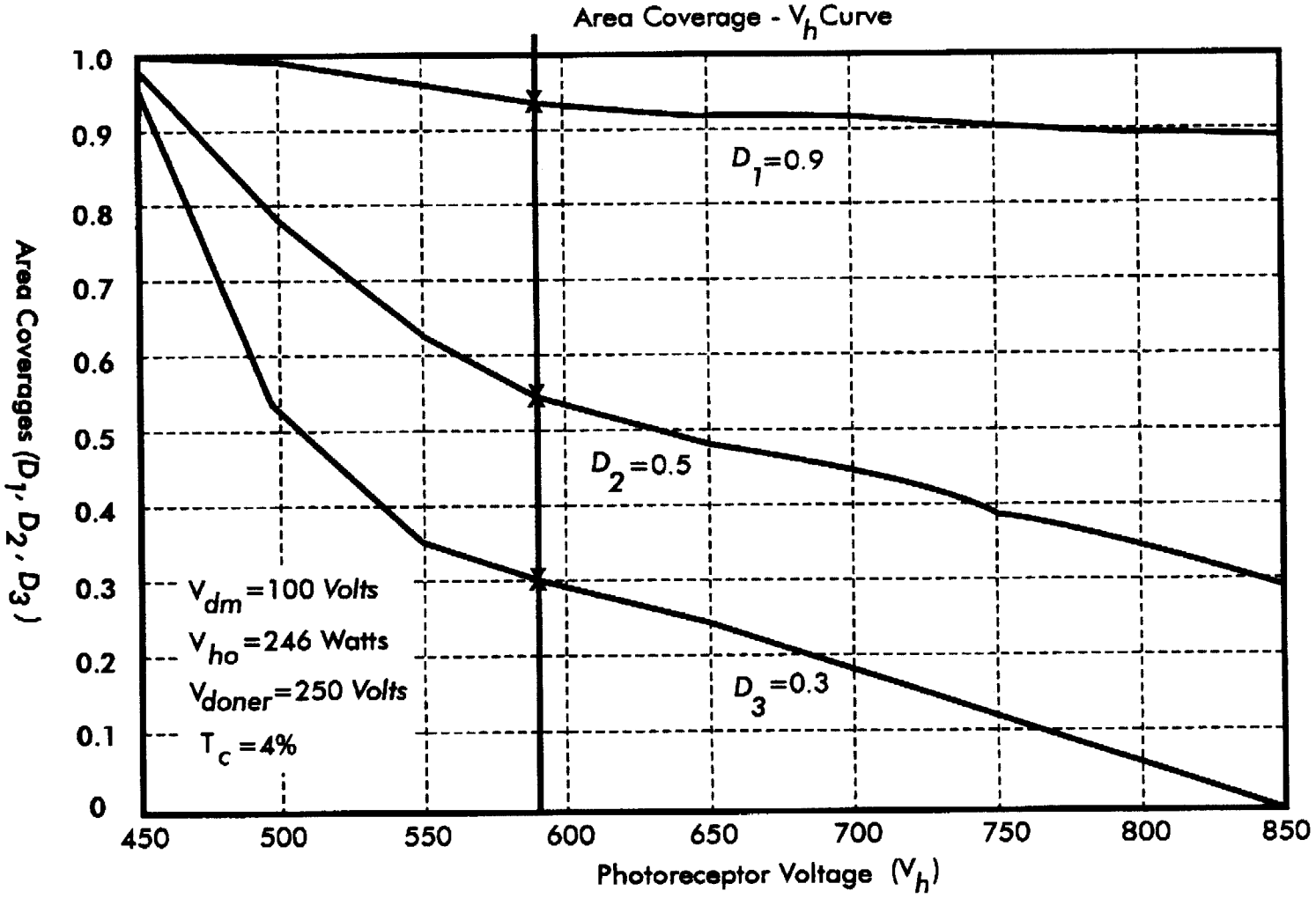

Curves in FIG. 9, 10, and 11 represent the static printer model for the system shown in FIG. 8. It is worth noting that the technique to extract the slopes and the table numbers is similar to that described under Level 1 control. Hence we have not repeated the steps. Denoting the new slopes, $B_{11}$, $B_{12}$, etc. at the operating point 'x' it is easy to obtain a small signal model of the control system. After going through the algebra the desired model becomes equal to:

$$\begin{bmatrix} X_1(k+1) \\ X_2(k+1) \\ X_3(k+1) \end{bmatrix} = \begin{bmatrix} 1 & 0 & 0 \\ 0 & 1 & 0 \\ 0 & 0 & 1 \end{bmatrix} \begin{bmatrix} X_1(k) \\ X_2(k) \\ X_3(k) \end{bmatrix} + \begin{bmatrix} B_{11} & B_{12} & B_{13} \\ B_{21} & B_{22} & B_{23} \\ B_{31} & B_{32} & B_{33} \end{bmatrix} \begin{bmatrix} U_1(k) \\ U_2(k) \\ U_3(k) \end{bmatrix}$$

$$\underline{X}(k+1) = \underline{AX}(k) + \underline{BU}(k)$$

These equations represent a good control model. It cannot be applied to xerography without the implementation of some form of adjustments to vary nominal actuator volumes in the form of feedforward lookup tables. The look up tables are the characteristics of the printer stored once in the memory. The number of points in the table depend on the maximum small deviations that can be tolerated in the DMA output. With combined use of lookup tables and the small signal models, very good print quality can be achieved without loosing the quality especially when the targets suddenly change in the middle of the run.

It is, therefore, apparent that there has been provided in accordance with the present invention, a charge control system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrostatographic printing machine having an imaging member with a surface including a control system having set point parameters comprising:

a sensor to measure said surface voltage potential, a compensator responsive to said surface voltage potential measured by the sensor to provide a first adjustment to the surface voltage potential, a device for changing the set point parameters, a look up table responsive to the changing of the set point parameters, the look up table being a feedforward look up table, and circuitry responsive to the voltage potential on a portion thereof, the electrostatographic printing machine changing of the set point parameters to provide a second adjustment to the surface voltage potential.

2. The electrostatographic printing machine of claim 1, wherein the circuitry responsive to the changing of the set point parameters to provide a second adjustment to the surface voltage potential is a summing node.

3. The electrostatographic printing machine of claim 1, including a summing node interconnected to a reference signal and the sensor measuring said surface voltage potential.

4. An electrostatographic printing machine having an imaging member with a surface voltage potential on a portion thereof, the electrostatographic printing machine including a control system having changeable set point parameters comprising:

a reference signal source, a sensor to measure the surface voltage potential, a compensator responsive to the reference signal and the surface voltage potential to provide one input signal to a summing node, a look up table responsive to the changing of the set point parameters to provide a second input signal to the summing node, and and an electrostatic device electrically connected to the summing node to adjust the surface voltage potential responsive to the look up table and compensator signals.

5. The electrostatographic printing machine of claim 4 wherein the look up table is a feedforward look up table.

6. An electrostatographic printing machine having an imaging member with a surface voltage potential on a portion thereof, the electrostatographic printing machine including a control system having set point parameters comprising:

a sensor to measure said surface voltage potential, a compensator responsive to said surface voltage potential measured by the sensor to provide a first adjustment to the surface voltage potential, a look up table responsive to the changing of the set point parameters, and a summing circuit responsive to the changing of the set point parameters to provide a second adjustment to the surface voltage potential.

7. The electrostatographic printing machine of claim 6, including a device for changing the set points.

8. The electrostatographic printing machine of claim 6, including a summing node interconnected to a reference signal and the sensor measuring said surface voltage potential.

9. An electrostatographic printing machine having an imaging member with a surface voltage potential on a portion thereof, the electrostatographic printing machine including a control system having changeable set point parameters comprising:

a reference signal source, a sensor to measure the surface voltage potential, a compensator responsive to the reference signal and the surface voltage potential to provide one input signal to a summing node, and a look up table responsive to the changing of the set point parameters to provide a second input signal to the summing node to adjust the surface voltage potential.

10. The apparatus of claim 9 including an electrostatic device electrically connected to the summing node to adjust the surface voltage potential responsive to the look up table and compensator signals.

11. In an electrostatographic printing machine having an imaging member with a surface voltage potential on a portion thereof, the electrostatographic printing machine including a control system having a sensor, a compensator, a look up table, and changeable set point parameters, a method of adjusting the surface voltage potential comprising the steps of:

storing a reference signal, sensing the surface voltage potential, responding by the compensator to the reference signal and the surface voltage potential to provide one input signal to a summing node, and responding by the look up table to the set point parameters to provide a second input signal to the summing node to adjust the surface voltage potential responsive to the look up table and compensator signals.

12. In an electrostatographic printing machine having an imaging member with a surface voltage potential on a portion thereof, the electrostatographic printing machine including a control system having a sensor, a compensator, a look up table, a summing node and changeable set point parameters, a method of adjusting the surface voltage potential comprising the steps sensing said surface voltage potential, responding to said surface voltage potential to provide a first adjustment to the surface voltage potential, responding to said surface voltage potential to provide a first adjustment to the surface voltage potential, recognizing the changing of the set point parameters to query the look up table, and responsive to the changing of the set point parameters, the table look up and the summing node providing a second adjustment to the surface voltage potential.

13. The method of claim 12, wherein the look up table is a feedforward look up table to provide the second adjustment.

14. The method of claim 13, including a summing node interconnected to a reference signal and the sensor measuring said surface voltage potential.

15. An electrostatographic printing machine having an imaging member and a plurality of operating components including a developer with toner for providing developed images, the electrostatographic printing machine including a control system having set point parameters comprising:

a sensor to measure developed toner mass on the imaging member a compensator responsive to said developed toner mass measured by the sensor to provide a first adjustment to the developed toner mass, a device for changing the set point parameters a feed forward look up table responsive to the changing of the set point parameters, and circuitry responsive to the changing of the set point parameters to provide a second adjustment to the developed toner mass.

16. The electrostatographic printing machine of claim 15, wherein the circuitry responsive to the changing of the set point parameters to provide a second adjustment to the developed toner mass is a summing node.

17. The electrostatographic printing machine of claim 15, including a summing node interconnected to a reference signal and the sensor measuring said developed toner mass.

18. An electrostatographic printing machine having an imaging member for providing developed images, the electrostatographic printing machine including a control system having changeable set point parameters comprising:

a reference signal source, a sensor to measure the developed toner mass, a compensator responsive to the reference signal and the developed toner mass to provide one input signal to a summing node, a look up table responsive to the changing of the set point parameters to provide a second input signal to the summing node, and and a device electrically connected to the summing node to adjust the developed toner mass in response to the look up table and compensator signals.

19. The electrostatographic printing machine of claim 18 wherein the look up table is a feedforward look up table.

20. An electrostatographic printing machine having an imaging member and a plurality of operating components to provide images on support material, the electrostatographic printing machine including a control system having set points comprising:

a sensor to measure operating component parameters, a compensator responsive to said parameters measured by the sensor and to a first look up table to provide a first level adjustment to one of the operating components, a second look up table responsive to the changing of the set points, and circuitry responsive to the changing of the set points to provide a second level adjustment to another operating component.

21. The electrostatographic printing machine of claim 20 wherein said first operating component is a charging device and said second operating component is a developer.

22. The electrostatographic printing machine of claim 20 wherein the first level of adjustment includes a developer and a charging device and a second level of adjustment includes the developer device.

23. In an electrostatographic printing machine having an imaging member and a control system including a sensor, a compensator, a look up table, and changeable set point parameters, a method of adjusting the parameters comprising the steps sensing a set point parameter, responding to said set point parameter to provide a first level table look up adjustment to the parameter, recognizing the set point parameter to require a second level of adjustment, and responding by providing a second level table look up adjustment to the parameter.

24. The method of claim 23, wherein the look up tables are feedforward look up tables.

* * * * *